US010711730B2

(12) United States Patent
Yamashita

(10) Patent No.: US 10,711,730 B2
(45) Date of Patent: Jul. 14, 2020

(54) INTERNAL COMBUSTION ENGINE

(71) Applicant: TOYOTA JIDOSHA KABUSHIKI KAISHA, Toyota-shi, Aichi-ken (JP)

(72) Inventor: Hideo Yamashita, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/528,924

(22) Filed: Aug. 1, 2019

(65) Prior Publication Data

US 2020/0102905 A1 Apr. 2, 2020

(30) Foreign Application Priority Data

Oct. 1, 2018 (JP) ..... 2018-186704

(51) Int. Cl.
*F02F 1/00* (2006.01)

(52) U.S. Cl.
CPC ..... *F02F 1/004* (2013.01)

(58) Field of Classification Search
CPC ..... F05C 2251/048; F05C 2253/12; F05C 2203/0886; F05C 2203/0817; F02F 3/14; F02B 77/11
USPC ..... 123/193.2, 193.4, 668
See application file for complete search history.

(56) References Cited

U.S. PATENT DOCUMENTS 4,711,208 A * 12/1987 Sander ..... F02B 23/0603 123/271
10,273,902 B2 * 4/2019 Schneider ..... C23C 4/11
2007/0259121 A1 * 11/2007 Shiratani ..... C09D 5/00 427/388.5
2012/0312189 A1 * 12/2012 Bessho ..... C09D 5/1662 106/2
2015/0204233 A1 * 7/2015 Nanba ..... F02F 1/18 123/668
2016/0177818 A1 6/2016 Nishikawa et al.
2017/0248099 A1 * 8/2017 Wagner ..... F02F 3/14
2017/0328300 A1 * 11/2017 Ikai ..... F16J 1/01

FOREIGN PATENT DOCUMENTS

JP 2015-031226 A 2/2015

* cited by examiner

*Primary Examiner* — Long T Tran
*Assistant Examiner* — James J Kim
(74) *Attorney, Agent, or Firm* — Oliff PLC

(57) ABSTRACT

A heat shielding film is formed on a surface wall constituting a combustion chamber. The heat shielding film includes a heat shielding layer and an oil repellent layer. The heat shield layer is formed on the wall surface. The heat shielding layer is composed of a material having thermal conductivity lower than base material of the combustion chamber. The oil repellent layer is formed on a surface of the heat shield layer. The oil repellent layer is composed of polyalkoxysiloxane. A contact angle of the oil repellent layer with engine oil is at least 40 degrees.

4 Claims, 4 Drawing Sheets

INTERNAL COMBUSTION ENGINE

CROSS-REFERENCE TO RELATED APPLICATION

The present disclosure claims priority under 35 U.S.C. § 119 to Japanese Patent Application No. 2018-186704, filed on Oct. 1, 2018. The content of the application is incorporated herein by reference in their entirety.

TECHNICAL FIELD

The present application relates to an internal combustion engine. More specifically, the present application relates an internal combustion engine including a heat shielding film which is formed on a wall constituting a combustion chamber.

BACKGROUND

JP2015-031226A discloses an internal combustion engine provided with a heat shielding film. The heat shielding film is formed on an aluminium-based wall surface that forms constitutes the combustion chamber. The heat shielding film includes an alumite layer and a sealing layer. The alumite layer is formed by anodization of the aluminim-based wall surface. The surface of the alumite layer has micro-pores which are formed during the anodization. The sealing layer is consisted of a sealing agent that seals inlets of the micro-pores. The sealing agent is polysilazane or polysiloxane.

The internal combustion engine is operated in various operation modes. The heavy use of certain operation modes (e.g., an intermittent operation during cold start, an idle operation) promotes generation of a deposit. When the deposit is generated on a wide area of the film surface, the action by the heat shielding film is inhibited. Therefore, in order to continuously exert the effect of heat shielding action, it is necessary to devise a method for suppressing the generation of the deposit on the film surface.

The present application addresses the above described problem, and one object of the present application is, to suppress the generation of deposits on the heat shielding film which is formed on the wall constituting combustion chamber in the internal combustion engine.

SUMMARY

A first aspect of the present application is an internal combustion engine for solving the problem described above and has the following features.

A heat shielding film is formed on a wall surface constituting a combustion chamber of the internal combustion engine.

The heat shielding film includes a heat shielding layer and an oil repellent layer.

The heat shield layer is formed on the wall surface.

The heat shielding layer is composed of a material having thermal conductivity lower than a base material of the combustion chamber.

The oil repellent layer is formed on a surface of the heat shield layer.

The oil repellent layer is composed of polyalkoxysiloxane.

A contact angle of the oil repellent layer with engine oil is at least 40 degrees.

A second aspect of the present application has the following features according to the first aspect.

Thermal capacity of the oil repellent layer is less than or equal to that of the heat shielding layer.

A third aspect of the present application has the following features according to the first aspect.

The wall surface includes a top surface of a piston and a bottom surface of a cylinder head.

The heat shielding film includes a first heat shielding film and a second heat shielding film.

The first heat shielding film is formed on the top surface.

The second heat shielding film is formed on the bottom surface.

The oil repellent layer includes a first oil repellent layer and a second oil repellent layer.

The first oil repellent layer is provided in the first heat shielding film.

The second oil repellent layer is provided in the second heat shielding film.

A first contact angle is greater than or equal to a second contact angle.

The first contact angle is a contact angle of the first oil repellent layer with the engine oil.

The second contact angle is a contact angle of the second oil repellent layer with the engine oil.

A fourth aspect of the present application has the following features according to the third aspect.

The first contact angle is larger than the second contact angle.

When the engine oil flowing into the combustion chamber solidifies, the deposit is generated. In this respect, according to the first aspect, since the surface of the heat shielding film is composed of the oil repellent layer, it is possible to suppress the solidification of the engine oil on the oil repellent layer. Therefore, it is possible to suppress the generation of the deposit on the surface of the heat shielding film.

When the thermal capacity of the oil repellent layer is high, temperature of the surface of the heat shielding film constantly increases. Then, air (i.e., intake air) sucked into the combustion chamber is heated, and abnormal combustion is likely to occur. In this respect, according to the second aspect, since the thermal capacity of the oil repellent layer is equal to or less than that of the heat shielding layer, it is possible to suppress the occurrence of such an adverse effect.

Most of the engine oil that has flowed into the combustion chamber is on the top surface rather than the bottom surface. The reason is that main reason of the inflow of the engine oil is vertical motion of the piston. In this respect, according to the third aspect, since the first contact angle is equal to or greater than the second contact angle, it is possible to appropriately suppress the solidification of the engine oil on the surface of the first heat shielding film.

According to the fourth aspect, since the first contact angle is larger than the second contact angle, it is possible to appropriately suppress the solidification of the engine oil on the surface of the first heat shielding film.

DESCRIPTION OF EMBODIMENT

Figure 1:
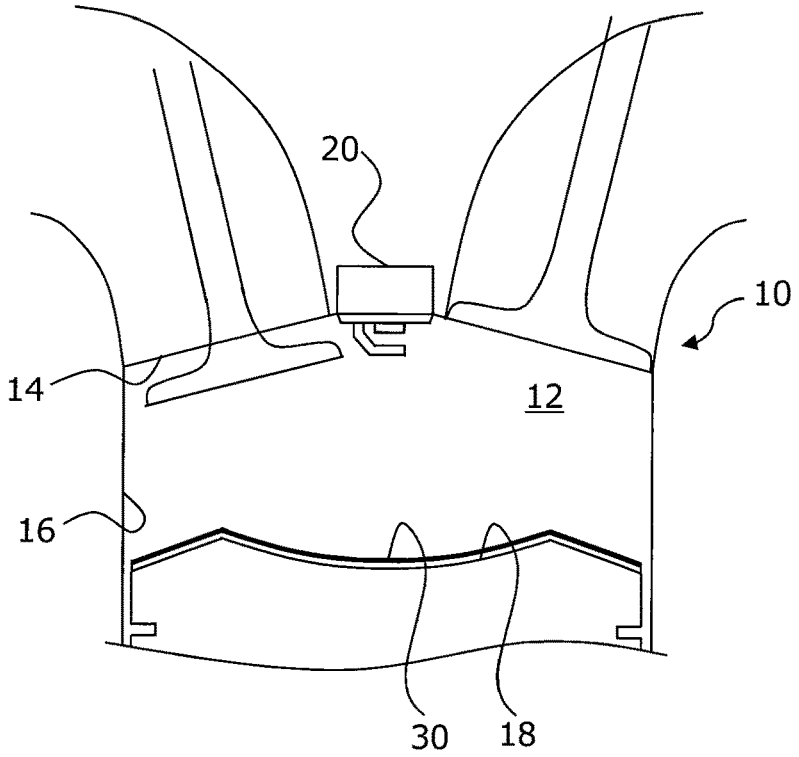
FIG. 1 is a view for explaining a configuration of a main part of an engine according to a first embodiment of a present application.

Hereinafter, embodiments of the present application will be described based on the accompanying drawings. Note that elements that are common to the respective drawings are denoted by the same reference characters and duplicate description thereof are omitted.

First Embodiment

First, a first embodiment of the present application will be described with reference to FIGS. 1 to 4.

1. Explanation for Internal Combustion Engine (Hereinafter Simply Referred to as an "Engine")

1.1 Explanation for Configuration of Main Part

An engine according to the first embodiment is a spark-ignition or compression self-ignition engine mounted on a vehicle. FIG. 1 is a diagram for explaining the configuration of the main part of the engine according to the first embodiment. An engine 10 shown in FIG. 1 includes a combustion chamber 12. The combustion chamber 12 is a space defined by a bottom surface 14 of a cylinder head, a surface 16 of a cylinder bore, and a top surface 18 of a piston. The bottom surface 14, the surface 16 and the top surface 18 are collectively referred to as wall surfaces that constitute the combustion chamber 12. The combustion chamber 12 includes an ignition apparatus 20 attached thereto. The ignition apparatus 20 ignites mixture in the combustion chamber 12.

The configuration of the main part shown in FIG. 1 is that of the spark ignition engine. When the engine relating to the first embodiment is configured by the compression self-ignition engine, the wall surface constituting the combustion chamber is defined in the same manner as the wall surface which constitutes the combustion chamber 12.

1.2 Explanation for Configuration of Heat Shield Film

Figure 2:
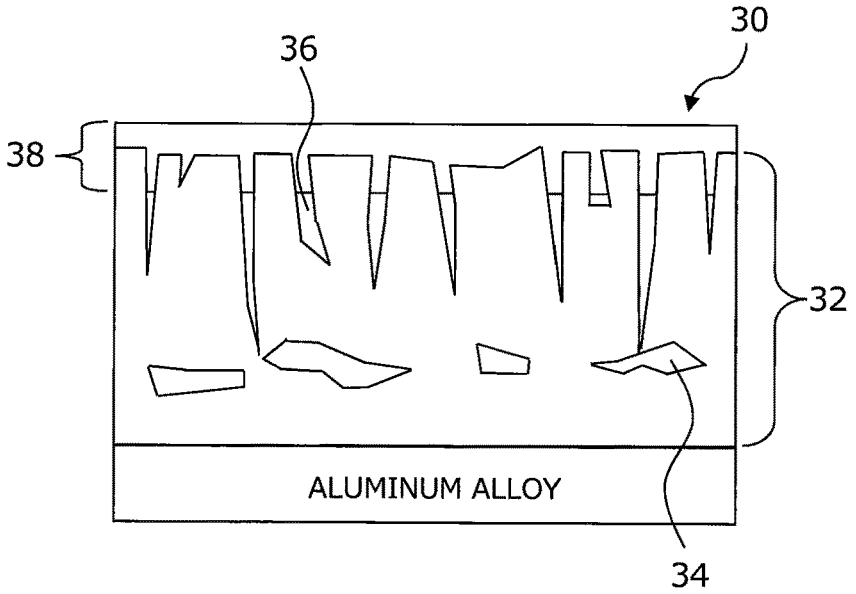
FIG. 2 is a view showing an example of the configuration of a heat shielding film.

The engine 10 includes a heat shielding film 30. The heat shield film 30 is formed on the top surface 18. FIG. 2 is a diagram showing an example of the configuration of the heat shielding film 30. As shown in FIG. 2, the heat shielding film 30 is provided with a heat shielding layer 32. The heat shield layer 32 is composed of porous alumina (i.e., alumite) formed by anodization of the top surface 18. The heat shield layer 32 has two types of pore portions 34 and 36. These pore portions are formed during anodization. The pore portion 34 is formed inside the heat shield layer 32. The pore portion 36 is formed on the surface of the heat shield layer 32. Due to these pore portions, alumite exhibits lower thermal conductivity than piston base material (specifically, aluminum alloy).

The heat shielding layer included in the heat shielding film 30 may be composed of porous ceramics. The porous ceramics are formed by thermal spraying treatment or baking treatment process. In the thermal spraying treatment, powders of ceramics such as zirconia, alumina and titania, or powders of composite ceramics such as cermet, mullite, cordierite and steatite are sprayed in a molten state onto the top surface 18. In the baking treatment process, a slurry containing powders described above is applied to the top surface 18 and then baked. The pore portions 34 and 36 are unique to alumite. Therefore, when the heat shielding layer is composed of the porous ceramics, the pore portions 34 and 36 are not formed. The porous ceramics exhibits lower thermal conductivity than the base material.

The heat shielding film 30 further includes an oil repellent layer 38. The oil repellent layer 38 is formed on the surface of the heat shield layer 32. The oil repellent layer 38 is composed of polyalkoxysiloxane. The polyalkoxysiloxane suitable for the oil repellent layer 38 will be described later. The oil repellent layer 38 seals each opening of the pore portion 36. The oil repellent layer 38 partially extends into middle of the pore portion 36. By the partial entrance to the middle of the pore portion 36, the oil repellent layer 38 is firmly coupled to the heat shield layer 32 (i.e., anchor effect). The polyalkoxysiloxane exhibits lower thermal conductivity than the base material.

2. Details of Oil Repellent Layer 38

2.1 Polyalkoxysiloxane

The polyalkoxysiloxane which constitutes the oil repellent layer 38 is a silicone polymer by which alkyl group R is introduced into a side chain of siloxane skeleton. The general formula of the polyalkoxysiloxane is as follows:

$$OH—(—SiR1R2O)n-H \quad (1)$$

Examples of the alkyl group R1 and R2 of the formula (1) include a methyl group, an ethyl group, a propyl group, butyl group, vinyl group, phenyl group and long chain alkyl group. However, when molecular weight of the alkyl group R is increased, lipophilic of the oil repellent layer 38 is increased (i.e., oil repellency is decreased). Therefore, the alkyl groups R1 and R2 preferably have small molecular weights. The alkyl groups R1 and R2 preferably include methyl group, ethyl group or propyl group. More preferably, both of the alkyl groups R1 and R2 include the methyl group.

2.2 Contact Angle $\theta_{38}$ of Oil Repellent Layer 38

The contact angle $\theta_{38}$ of the oil repellent layer 38 with engine oil is 40 degrees or more. The engine oil is a lubricant of the engine 10. The engine oil may flow into the combustion chamber 12 due to vertical motion of the piston. When the engine oil flowing into the combustion chamber 12 solidifies, a deposit is generated. The contact angle $\theta_{38}$ is measured by a general measurement method (e.g., θ/2 method, tangent line method, curve fitting method). The contact angle $\theta_{38}$ may be a dynamic contact angle.

2.3 Thermal Capacity $C_{38}$ of Oil Repellent Layer 38

Thermal capacity $C_{38}$ of the oil repellent layer 38 is preferably equal to or less than the thermal capacity $C_{32}$ of the heat shielding layer 32. When the thermal capacity $C_{38}$ is high, the surface of the heat shielding film 30 is constantly heated to a high temperature. Then, air sucked into the combustion chamber 12 is heated, and abnormal combustion is likely to occur. In this respect, if the thermal capacity $C_{38}$ is less than the thermal capacity $C_{32}$, it is possible to suppress the occurrence of such an adverse effect. The thermal capacity $C_{38}$ is preferably lower than thermal capacity $C_{32}$. If the thermal capacity $C_{38}$ is lower than the thermal capacity $C_{32}$, this suppression effect is enhanced. Note that an adjustment of the magnitude relation of the thermal capacity C is realized by increasing or decreasing volume of the oil repellent layer 38. The volume of the oil repellent layer 38 is realized by increasing or decreasing weight of polyalkoxysiloxane.

3. Explanation of Experimental Data

Figure 3:
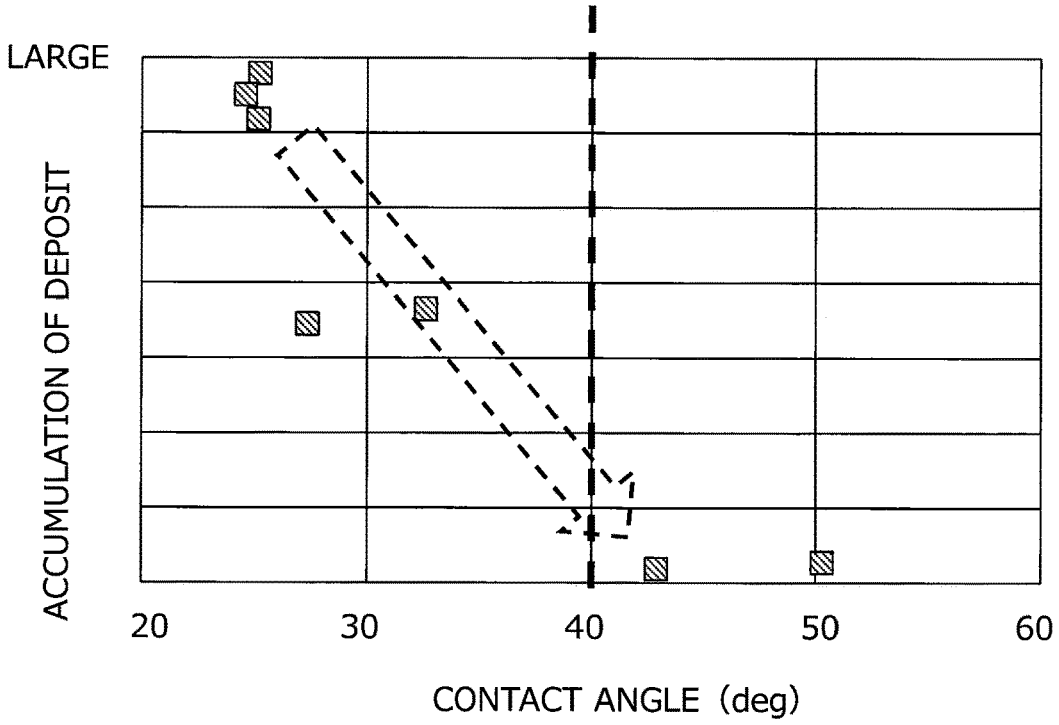
FIG. 3 is data showing a relationship between an amount of deposit accumulated on an oil repellent layer and contact angle θ.

FIG. 3 is data showing a relationship between amount of deposits accumulated on an oil repellent layer and contact angle θ. The contact angle θ shown in FIG. 3 was measured as follows. First, samples of oil repellent films were prepared using various silicon-based coating materials. Subsequently, the engine oil was dropped from a nozzle to each of these samples. The measurement of the contact angle θ was performed at ambient temperature of 25° C. The accumulated amount of the deposit was measured using an oil repellent layer formed of the same coating material as the sample for which the contact angle θ was measured.

It can be seen from FIG. 3 that in the engine in which the oil repellent layer having contact angle θ of less than 40 degrees (more precisely, 32 degrees) is formed, many deposits are deposited on the oil repellent layer. The data showing the contact angle θ=32 degrees corresponds to that of the oil repellent layer composed of polysilazane. Further, it can also be seen from FIG. 3 that the accumulation of the deposit is suppressed in the engine in which the oil repellent layer having the contact angle θ of 40 degrees (more accurately, 42 and 51 degrees) is formed. The data of the contact angle θ of 42 and 51 degrees corresponds to that of the oil repellent layer formed from polydimethylsiloxane.

The tendency of the data shown in FIG. 3 indicates that generation of the deposit on the heat shielding film can be suppressed by using the oil repellent layer having the contact angle θ of 40 degrees or more with the engine oil. The reason for this is presumed to be that the engine oil flowing into the combustion chamber was prevented from solidifying on the oil repellent layer.

Figure 4:
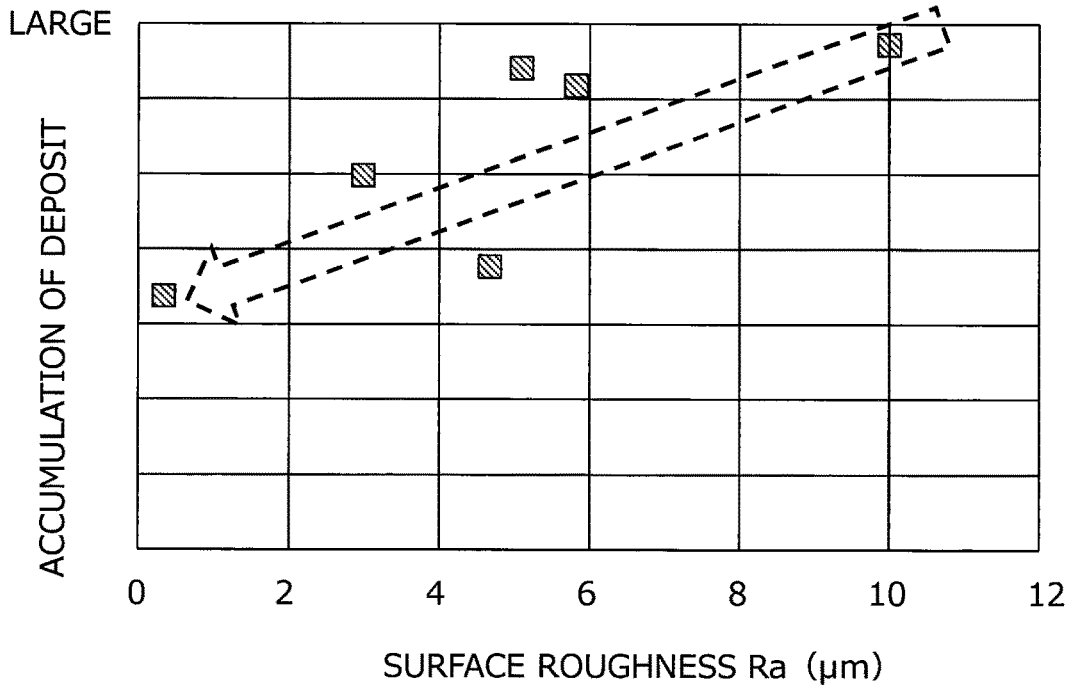
FIG. 4 is data showing the relationship between the amount of the deposit accumulated on the oil repellent layer and surface roughness Ra.

FIG. 4 is data showing a relationship between an amount of deposit accumulated on an oil repellent layer and surface roughness Ra. The surface roughness Ra shown in FIG. 4 was adjusted by polishing the surface of the heat shielding film without the oil repellent layer (i.e., the film having only the heat shielding layer). The accumulated amount of the deposit was measured by using the heat shielding film whose surface roughness Ra was measured.

It can be seen from FIG. 4 that as the surface roughness Ra decreases, the accumulated amount of the deposit decreases. However, it is also understood that a certain amount of the deposit is accumulated even when the heat shielding film having the surface roughness Ra of less than 1 μm is used.

The tendency of the data shown in FIG. 4 indicates that simply reducing the surface roughness Ra of the heat shielding film does not keep the effect of the heat shielding action continuously.

4. Advantageous Effect of Heat Shield Film 30

According to the engine of the first embodiment, it is possible to suppress the generation of the deposit on the heat shielding film. Therefore, it is possible to continuously exert the effect of the heat shielding action. Also, if the thermal capacity $C_{38}$ is less than the thermal capacity $C_{32}$, it is possible to suppress the occurrence of the abnormal combustion by suppressing the heating of air sucked into the combustion chamber.

Second Embodiment

Next, a second embodiment of the present application will be described with reference to FIG. 5. Note that the description which overlaps with that of the first embodiment will be omitted appropriately.

1. Explanation for Engine

Figure 5:
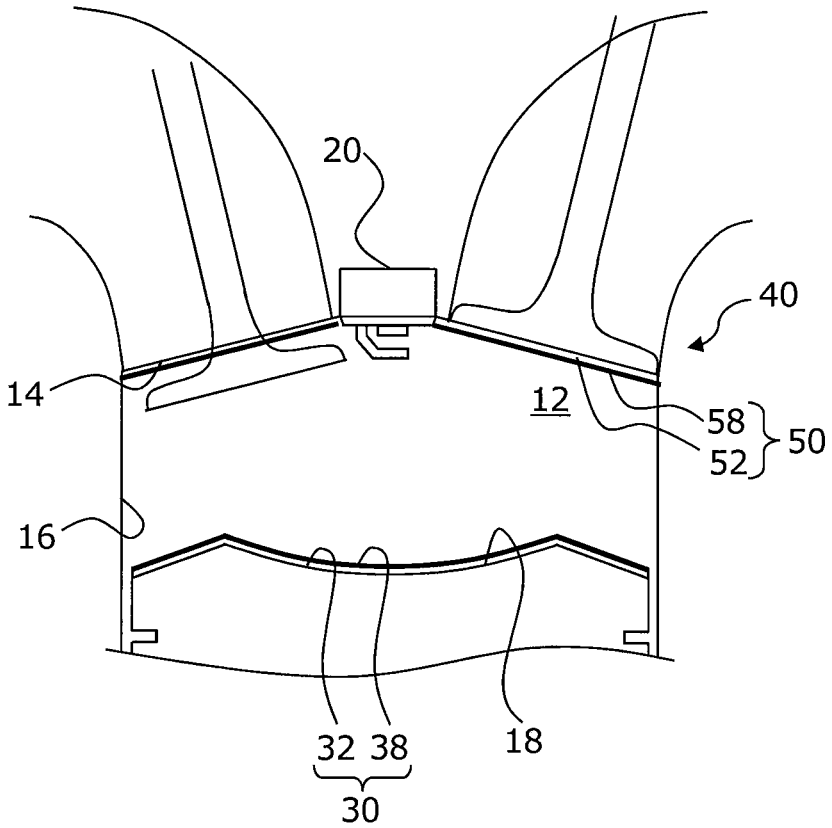
FIG. 5 is a view for explaining the configuration of the main part of the engine according to the second embodiment of the present application.

FIG. 5 is a diagram for explaining the configuration of the main part of the engine according to the second embodiment. An engine 40 shown in FIG. 5 includes a heat shielding film 50 in addition to the heat shielding film 30. The heat shield film 50 is formed on the bottom surface 14. The composition of the heat shielding film 50 is identical to that of the heat shielding film 30. In other words, the heat shielding film 50 includes a heat shielding layer 52 and an oil repellent layer 58. The heat shielding layer 52 is composed of alumite. The oil repellent layer 58 is composed of polyalkoxysiloxane. The contact angle $\theta_{58}$ of the oil repellent layer 58 with the engine oil is 40 degrees or more.

2. Magnitude Relationship Between Contact Angle $\theta_{58}$ and $\theta_{38}$

The contact angle $\theta_{58}$ is desirably equal to or less than the contact angle $\theta_{38}$. In other words, it is desirable that the contact angle $\theta_{38}$ is greater than or equal to the contact angle $\theta_{58}$. Most of the engine oil that has flowed into combustion chamber 12 is on the top surface 18 rather than on the bottom surface 14. The reason is that main reason of the inflow of the engine oil is the vertical motion of the piston. In this regard, when the contact angle $\theta_{38}$ is greater than or equal to the contact angle $\theta_{58}$, the solidification of the engine oil on the oil repellent layer 38 is appropriately suppressed. When the contact angle $\theta_{38}$ is smaller than the contact angle $\theta_{58}$, this suppression effect is enhanced. Note that the adjustment of the magnitude relationship of the contact angle θ is realized by composing of the oil repellent layers 38 and 58 with different polyalkoxysiloxane.

3. Advantageous Effect of Heat Shielding Film

According to the engine of the second embodiment, the same effect as the first embodiment described above is obtained. In addition, when the contact angle $\theta_{38}$ is equal to or greater than the contact angle $\theta_{58}$, it is possible to appropriately suppress the solidification of the engine oil on the oil repellent layer 38.

Third Embodiment

Next, a third embodiment of the present application will be described with reference to FIG. 6. Note that the description which overlaps with that of the first or second embodiment will be omitted appropriately.

1. Explanation for Engine

Figure 6:
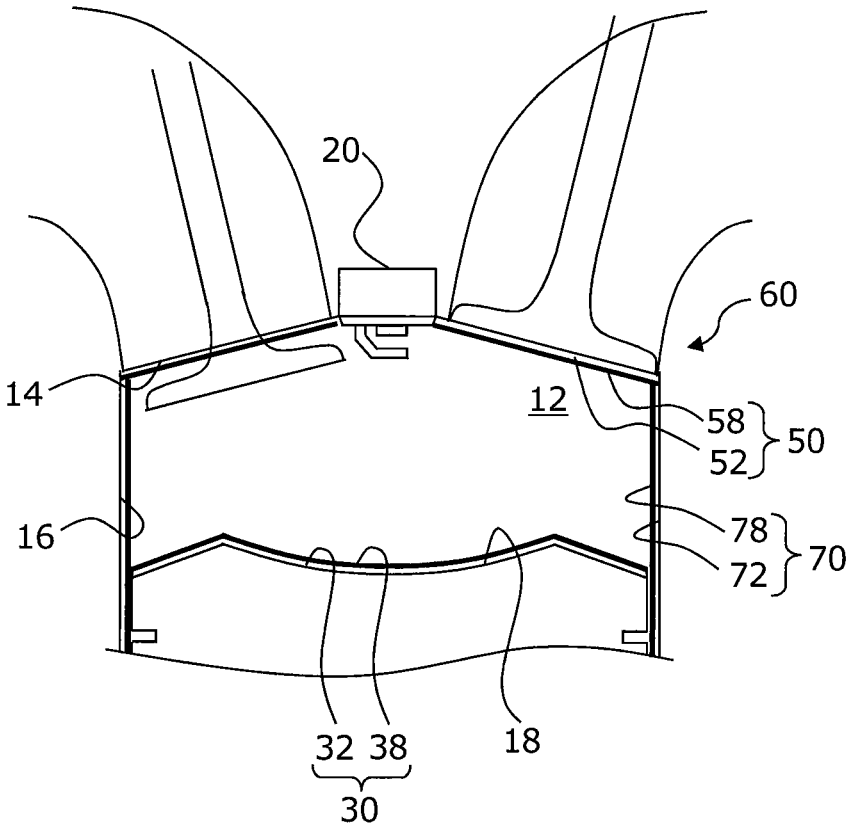
FIG. 6 is a view for explaining the configuration of the main part of the engine according to the third embodiment of the present application.

FIG. 6 is a diagram for explaining the configuration of the main part of the engine according to the third embodiment. An engine 60 shown in FIG. 6 includes a heat shielding film 70 in addition to the heat shielding films 30 and 50. The heat shielding film 70 is formed on the surface 16. The composition of the heat shielding film 70 is identical to that of the heat shielding film 30. In other words, the heat shielding film 70 includes a heat shielding layer 72 and an oil repellent layer 78. The heat shield layer 72 is composed of alumite. The oil repellent layer 78 is composed of polyalkoxysiloxane. The contact angle $\theta_{78}$ of the oil repellent layer 78 with the engine oil is 40 degrees or more.

2. Advantageous Effect of Heat Shielding Film

According to the engine relating to the third embodiment, the same effect as the first embodiment described above is obtained.

Other Embodiments

The first to third embodiments have been described based on an assumption that the engine has the heat shielding film 30. However, an engine not equipped with the heat shielding film 30 is also included in the engine related to the present application. In other words, an engine having only the heat shielding film 50, an engine having only the heat shielding film 70, or an engine having the heat shielding films 50 and 70 is included in the embodiments of the present application.

Note that, even when the embodiment described above mentions about a value such as number, quantity, amount and range, the present application is not limited by the referred values unless the value is explicitly referred in the present application or clearly specified to the value in principle. In addition, the configuration of the embodiment described above is not essential to the present application unless explicitly referred in the present application or clearly specified to the configuration in principle.

What is claimed is:

1. A internal combustion engine including a combustion chamber constituted by a wall surface on which a heat shielding film is formed, wherein:

the heat shielding film includes a heat shielding layer and an oil repellent layer;

the heat shielding layer is formed on the wall surface and also is composed of a material having thermal conductivity lower than a base material of the combustion chamber;

the oil repellent layer is formed on a surface of the heat shield layer and also is composed of polyalkoxysiloxane; and a contact angle of the oil repellent layer with engine oil is at least 40 degrees.

2. The internal combustion engine according to claim 1, wherein thermal capacity of the oil repellent layer is less than or equal to that of the heat shielding layer.

3. The internal combustion engine according to claim 1, wherein:

the wall surface includes a top surface of a piston and a bottom surface of a cylinder head;

the heat shielding film includes a first heat shielding film which is formed on the top surface and a second heat shielding film which is formed on the bottom surface;

the oil repellent layer includes a first oil repellent layer which is provided in the first heat shielding film and a second oil repellent layer which is provided in the second heat shielding film; and a first contact angle which is a contact angle of the first oil repellent layer with the engine oil is greater than or equal to a second contact angle which is a contact angle of the second oil repellent layer with the engine oil.

4. The internal combustion engine according to claim 3, wherein the first contact angle is larger than the second contact angle.

* * * * *